US009611720B2

(12) United States Patent
Sevheim et al.

(10) Patent No.: US 9,611,720 B2
(45) Date of Patent: Apr. 4, 2017

(54) VALVE ARRANGEMENT AND METHOD OF OPERATING THE SAME

(71) Applicant: Petroleum Technology Company AS, Stavanger (NO)

(72) Inventors: Ole Sevheim, Stavanger (NO); Erling Kleppa, Jorpeland (NO); Kristian Harestad, Randaberg (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 0 days.

(21) Appl. No.: 14/652,803

(22) PCT Filed: Feb. 4, 2014

(86) PCT No.: PCT/EP2014/052080

§ 371 (c)(1),
(2) Date: Jun. 17, 2015

(87) PCT Pub. No.: WO2014/118380

PCT Pub. Date: Aug. 7, 2014

(65) Prior Publication Data

US 2015/0330183 A1 Nov. 19, 2015

(30) Foreign Application Priority Data

Feb. 4, 2013 (NO) ..... 20130179

(51) Int. Cl.
*E21B 34/10* (2006.01)
*E21B 43/12* (2006.01)

(52) U.S. Cl.
CPC ..... *E21B 34/10* (2013.01); *E21B 43/123* (2013.01)

(58) Field of Classification Search
CPC ..... E21B 43/123; E21B 34/106; E21B 34/107
See application file for complete search history.

(56) References Cited

U.S. PATENT DOCUMENTS 5,022,427 A 6/1991 Churchman
5,535,767 A 7/1996 Schnatzmeyer
(Continued)

FOREIGN PATENT DOCUMENTS

NO 329607 11/2010
WO 2009/113875 9/2009
WO 2010062187 6/2010

OTHER PUBLICATIONS

ISR of Nov. 6, 2014.
Norwegian Search Report of Aug. 30, 2013, submitted inter alia as statement of relevance for non English referenes.

*Primary Examiner* — Robert E Fuller
(74) *Attorney, Agent, or Firm* — Birch, Stewart, Kolasch & Birch, LLP

(57) ABSTRACT

A valve arrangement for controlling the flow of an injection fluid from a well annulus into a hydrocarbon well, includes a valve body being insertable into a side pocket mandrel, an injection fluid valve for controlling the flow of the injection fluid through the valve arrangement and a bellows arrangement including a first pressure member, a second pressure member and at least one bellows element. A control line port is arranged in the valve body for fluid communication with a control line of the well and a control fluid chamber in fluid communication with the control line port comprises a hydraulic control fluid for biasing the injection fluid valve towards the open position.

12 Claims, 4 Drawing Sheets

(56) References Cited

U.S. PATENT DOCUMENTS

| | | | | |
|---|---|---|---|---|
| 2003/0111231 | A1 | 6/2003 | Faustinelli | |
| 2004/0182437 | A1 | 9/2004 | Messick | |
| 2011/0067879 | A1 * | 3/2011 | Kleppa | E21B 34/08<br>166/326 |

* cited by examiner

VALVE ARRANGEMENT AND METHOD OF OPERATING THE SAME

FIELD OF THE INVENTION

The present invention relates to a valve arrangement for controlling the flow of an injection fluid from a well annulus into a well conduit of a hydrocarbon well, comprising:

- a valve body being insertable into a side pocket mandrel of the hydrocarbon well, the valve body comprising:
  - at least one inlet port for receiving the injection fluid from the well annulus,
  - at least one outlet port for delivering the injection fluid to the well conduit,
  - an injection fluid valve being arranged in fluid communication with the least one inlet port and the at least one outlet port and being operable between an open position and a closed position for controlling the flow of the injection fluid through the valve arrangement,
  - an actuating device for biasing the injection fluid valve towards the closed position, and
  - a bellows arrangement comprising a first pressure member, a second pressure member and at least one bellows element enclosing at least one bellows chamber comprising a bellows fluid, wherein the pressure members are hydraulically connected via the bellows fluid, wherein the injection fluid valve is connected to the second pressure member and the actuating device is arranged adjacent to the first pressure member for biasing the injection fluid valve towards the closed position via the first pressure member, the bellows fluid and the second pressure member.

In particular, the present invention relates to a valve arrangement for unloading and gas lifting operations in a hydrocarbon well.

The present invention also relates to a method of operating such a valve arrangement in a hydrocarbon well, and also to a side-pocket mandrel comprising such a valve arrangement.

BACKGROUND

In known valves of the above-identified type, the bellows arrangement is positioned adjacent to the injection fluid chamber such that the injection fluid which enters the valve arrangement from the well annulus can act on the second pressure member of the bellows arrangement. When the pressure of the injection fluid acting on the second pressure member overcomes the pressure by which the actuating device influences the first pressure member, the second pressure member will open the injection fluid valve. A valve of this type is disclosed in WO 2010/062187 A1.

However, the exposure of the bellows arrangement to the fluctuating pressure of the injection fluid in the annulus poses a problem with this type of valve arrangement. In particular, due to the exposure to the fluctuating pressure of the injection fluid, the bellows will be subjected to a large number of compression-expansion cycles during its operative life, which may cause the bellows and the valve arrangement to fail.

BRIEF SUMMARY OF THE INVENTION

An object of the present invention is to solve this problem and provide a valve arrangement which is subjected to a reduce number of bellows cycles and, therefore, has an improved life expectancy.

The valve arrangement according to the invention is characterised in that it comprises:

- at least one control line port being arranged in the valve body for fluid communication with a control line of the well, and
- a control fluid chamber being arranged inside the valve body adjacent to the second pressure member and in fluid communication with the at least one control line port, wherein the control fluid chamber comprises a hydraulic control fluid for biasing the injection fluid valve towards the open position via the second pressure member.

By increasing the pressure in the control line, and consequently increasing the pressure in the control fluid chamber, an operator can directly influence the second pressure member and, thus, the movement of the injection fluid valve.

The actuating device may be a gas-charged dome, a compression spring, a hydraulic or electric actuator or any other actuating device capable of providing an actuating movement.

The primary benefit of the valve arrangement according to the invention is a reduction in the number of cycles required for the bellows arrangement or system. The reduction in required cycles is achieved because the bellows movement is controlled by pressure in the control line. This means the operator will have full control over the bellows movement during its entire lifetime. The only time the bellows will be operated is when the well is started up initially and after shut downs, or when a valve is closed during gas lifting when it has been used as an operating valve. In addition, in a valve arrangement according to the invention there will be no chattering or rapid cycling of the bellows arrangement during pressure shifting or depletion, which also will reduce the potential number of required cycles.

Another benefit of the valve arrangement according to the invention is the possibility of performing a pressure test of the annulus without having dummies, i.e. dummy valves, installed in the side-pocket mandrels. Proper adjustment of control line pressure and actuating device pressure will ensure that high annulus pressure do not open the valves when control line pressure is zero at the surface. After the annulus pressure test if completed, control line pressure can be increased to open valves as required. The benefit of being able to pressure test the annulus will remove the requirement for wireline intervention after the well completion phase, since the annulus pressure test can be performed without having dummies installed inside the side-pocket mandrels. It will also allow for performing acid stimulation jobs without having to pull orifice and injection pressure operated valves and replace them with dummies.

Advantageously, the bellows arrangement is a dual bellows arrangement, i.e. a bellows arrangement comprising two bellows chambers being in fluid communication with each other. However, any type of bellows arrangement known in the art may be used.

It may be advantageous to arrange the actuating device, the bellows arrangement and the injection fluid valve along a central axis of the valve body such that a space efficient configuration is achieved.

BRIEF DESCRIPTION OF THE DRAWINGS

In the following, a embodiments of the present invention will be disclosed in more detail.

The embodiments are illustrated in the attached drawings, where.

DETAILED DESCRIPTION OF THE INVENTION

Figure 1:
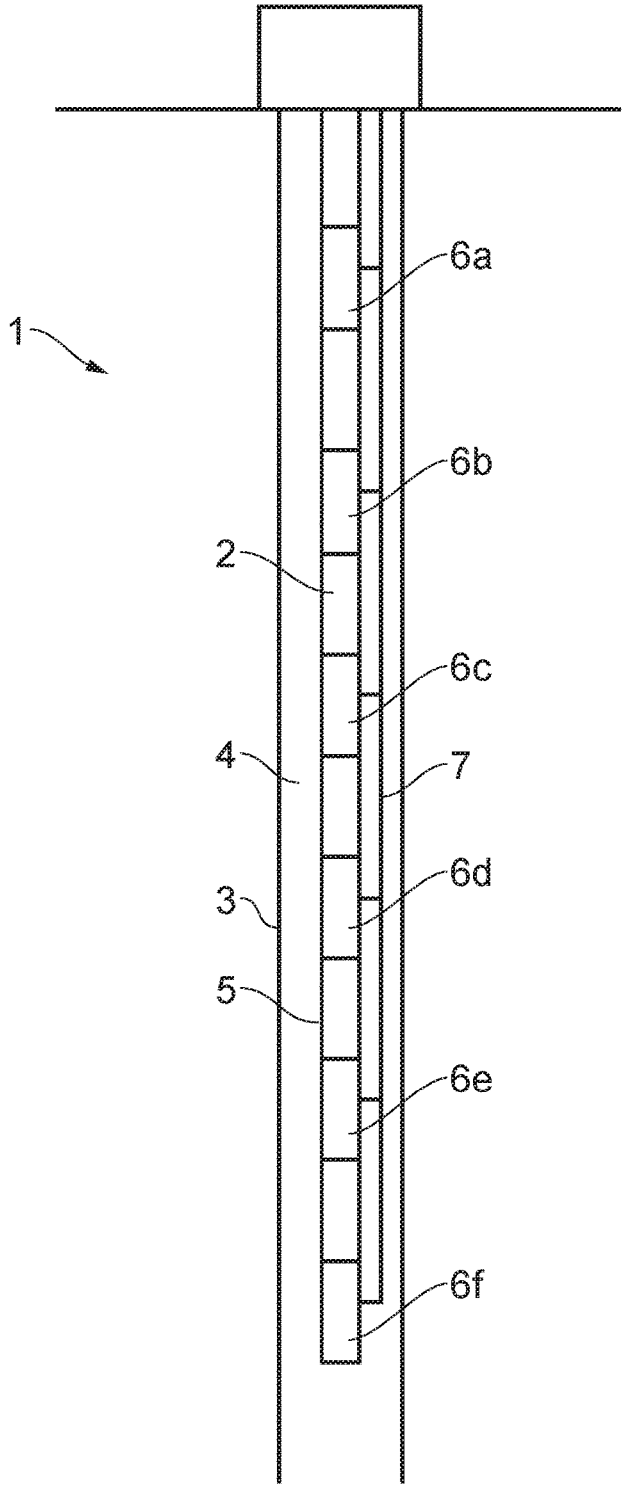
FIG. 1 is a schematic depiction of a hydrocarbon well comprising a gas lift system comprising side-pocket mandrels comprising a valve arrangement according to the invention.

In the disclosure that follows, like parts are marked through-out the specification and drawings with the same reference numerals. The figures are not necessarily drawn to scale, and, in some instances, have been exaggerated or simplified to clarify certain features of the invention. Also, within the scope of this disclosure, the terms "upper" and "lower", and corresponding terms "above", "below", "upward", "downward" etc., are only relative terms used to indicate relative positions and movements within the feature discussed and are not to be given their absolute meanings as within an earth based reference system.

FIG. 1 discloses a hydrocarbon well 1 comprising a production string 2 which is surrounded by a casing 3 forming a well annulus 4 between the production string 2 and the casing 3. The production string 2 comprises a production tubing or well conduit 5 having a plurality of side-pocket mandrels **6*a*-6*f* arranged along the length of the tubing 5**.

Each side-pocket mandrel **6*a*-6*f* comprises a valve arrangement according to the invention. Also, running along the length of the production string 2, the well 1 comprises a hydraulic surface control line 7 which is connected to each side-pocket mandrel 6*a*-6*f*** in order to operate the valve arrangement mounted therein in a manner which will be disclosed in the following.

An embodiment of a valve arrangement 8 according to the invention will now be discussed with reference to FIG. 2.

The valve arrangement 8 comprises an elongated and generally cylindrical valve body 9 which may be made from one or a plurality of body sections. The shape of the valve body 9 is such that the valve arrangement 8 can be sealably inserted in a pocket of a side-pocket mandrel in a manner which is known in the art. To this end, the shape of the valve body 9 generally corresponds to the shape of the inner side wall of the pocket and the valve arrangement 8 may be installed and removed from the side-pocket mandrel in a manner which is known in the art, e.g. by means of a wireline operation.

The valve body 9 comprises a first, upper end 60 and a second, lower end 61. As previously stated, the terms "upper" and "lower", and the corresponding terms "above", "below", "upward", "downward" etc., are only relative terms used to indicate relative positions and movements and are not to be given an absolute meaning. For example, depending on the situation, the valve arrangement 8 may be mounted with the upper end 60 below or at the same level as the lower end 61.

The valve body 9 comprises one or a plurality of inlet ports 10 for receiving injection fluid from the well annulus via a corresponding opening or openings in the side pocket mandrel in a manner which is, as such, known in the art. Below the inlet ports 10, at the lower end 61 of the valve body 9, the valve body 9 comprises one or a plurality of outlet ports 11 for delivering the injection fluid to the production tubing directly or via a corresponding opening or openings in the side-pocket mandrel in a manner which is, as such, also known in the art. Above the inlet ports 10 the valve body 9 comprises one or a plurality of control line ports 12 which are arranged to communicate with a hydraulic control line 7 (see FIG. 1) via a corresponding opening or openings in the side-pocket mandrel. Consequently, in the longitudinal direction of the valve body 9, the inlet ports 10 are positioned between the outlet ports 11 and the control line ports 12.

The valve arrangement 8 further comprises first 13, second 14 and third 15 annular sealing arrangements or seal stacks which are arranged around the valve body 9 to provide fluid tight seals between the valve body 9 and the generally cylindrical inner side wall of the receiving pocket (not disclosed) of the side-pocket mandrel when the valve arrangement 8 is mounted therein. The control line ports 12 are positioned between the first seal stack 13 and the second seal stack 14 such that the seal stacks 13 and 14 seal of an annular space or recess 16 surrounding the control line ports 12 when the valve arrangement 8 is mounted in the side-pocket mandrel, which space or recess is configured to form the interface between the control line ports 12 and the corresponding opening or openings of the side-pocket mandrel. The inlet ports 10 are positioned between the second seal stack 14 and the third seal stack 15 such that the seal stacks 14 and 15 seal of the inlet ports 10 when the valve arrangement 8 is mounted in the side-pocket mandrel. The outlet ports 11 are positioned below the third seal stack 15 such that leakage between the well annulus and the well conduit via the openings of the side-pocket mandrel is prevented.

The valve arrangement 8 comprises an injection fluid chamber 18 which is arranged inside the valve body 9 in fluid communication with the inlet ports 10.

The valve arrangement 8 also comprises an injection fluid valve 19 which is arranged in fluid communication with the injection fluid chamber 18 and is operable between an open position and a closed position for controlling the flow of the injection fluid through the valve arrangement 8. The injection fluid valve 19 comprises a valve stem 20 and a valve seat 21. The valve seat 21 is stationary mounted in the valve body 9. The valve stem 20, on the other hand, is movably mounted in the valve body 9 such that it can be operated up and down in the longitudinal direction of the valve body 9 and such that a valve stem head 17 of the valve stem 20 can be brought out of and into contact with the valve seat 21 and, thus, bring the injection fluid valve 19 into the open and the closed position, respectively.

The valve arrangement 8 further comprises an actuating device 22 which is connected to the injection fluid valve 19 for biasing the valve 19 towards the closed position.

In the disclosed embodiment, the actuating device 22 comprises an actuating member in the form of a gas-charged dome 23, i.e. a dome filled with a pressurised gas, e.g. nitrogen gas. Alternatively, the actuating member can be a compression spring, a control line operated hydraulic piston or any other type of means for providing an actuating force.

The actuating device 22 is connected to the injection fluid valve 19 via a bellows arrangement 24 which is arranged inside the valve body 9 below the actuating device 22, i.e. between the actuating device 22 and the injection fluid valve 19. In the disclosed embodiment the bellows arrangement 24 comprises a ring element 31, a generally cylindrical first, upper pressure member 26 arranged above the ring element 31 and a generally cylindrical second, lower pressure member 27 arranged below the ring element 31. The bellows arrangement 24 further comprises a generally cylindrical first, upper bellows element 34 and a generally cylindrical second, lower bellows element 35. The bellows elements 34, 35 advantageously comprise folded or interconnected metal sheets capable of an accordion like movement. Such bellows elements are, as such, known in the art and will not be disclosed further here. The upper end 36 of the upper bellows element 34 is connected to the upper pressure member 26, and the lower end 37 of the upper bellows element 34 is connected to the ring element 31, as is disclosed in FIG. 2, such that the upper bellows element 34 encloses a first, upper bellows chamber. In a similar manner, the upper end 39 of the lower bellows element 35 is connected to the ring element 31 and the lower end 40 of the lower bellows element 35 is connected to the lower pressure member 27 such that the lower bellows element 35 encloses a second, lower bellows chamber. The bellows chambers are filled with an incompressible fluid, e.g. silicon oil or another hydraulic fluid. Furthermore, the bellows chambers are in fluid communication with each other via a one or a plurality of openings or channels in the ring element 31 such that the hydraulic bellows fluid can flow between the bellows chambers. Consequently, the pressure members 26 and 27 are hydraulically connected to each other via the openings or channels in the ring element 31. When the bellows arrangement 24 is mounted in the valve body 9, the ring 31 is rigidly attached to the valve body 9, and the mantle surfaces of the pressure members 26 and 27 are arranged to slide against the inner, cylindrical surface 42 of the valve body 9. Consequently, the bellows arrangement 24 is configured to be operable between a first, upper end position, in which the upper bellows 34 is extended and the lower bellows 35 is completely compressed, and a second, lower end position, in which the upper bellows 34 is completely compressed and the lower bellows 35 is extended, as is disclosed in FIG. 2. When the bellows arrangement 24 is brought from the upper end position to the lower end position, the bellows fluid is brought to flow from the upper to the lower bellows chamber via the channel or channels in the ring element 31, and when the bellows arrangement 24 is brought from the lower to the upper end position, the bellows fluid is brought to flow in the other direction, i.e. from the lower to the upper bellows chamber via the channel or channels in the ring element 31. This provides for a controlled movement of the bellows arrangement 24 when the pressure members 26 and 27 are actuated.

The bellows arrangement 24 is positioned adjacent to the first actuating device 22, i.e. the gas-charged dome 23 in the disclosed embodiment, such that the upper pressure member 26 is subjected to the biasing force of the first actuating device 22, i.e. the force resulting from the pressure of the gas in the dome 23 in the present embodiment. The lower pressure member 27 is attached to the valve stem 20. Consequently, the downwardly directed force generated by the first actuating device 22 will be transferred to the valve stem 20 via the hydraulic fluid in the bellows chambers, thus biasing the injection fluid valve 19 towards its closed position. However, when the bellows arrangement 24 reaches its lower end position, in which the upper bellows 34 is completely compressed, the upper pressure member 26 will rest on the ring element 31 via the compressed bellows 34, as is disclosed in FIG. 2, which ring element 31 will then take the biasing force from the first actuating device 22.

The valve arrangement 8 further comprises a control fluid chamber 30 for the containment of a hydraulic control fluid. The chamber 30 is arranged inside the valve body 9 adjacent to the lower pressure member 27. The chamber 30 is in fluid communication with the control line ports 12 such that the pressure of the control fluid in the control fluid chamber 30 can be controlled via the control line 7 (see FIG. 1). Consequently, the lower pressure member 27 is subjected to the pressure of the control fluid in the chamber 30, and the upwardly directed force generated by the control fluid in the chamber 30 will therefore be transferred to the valve stem 20 via the lower pressure member 27, thus biasing the injection fluid valve 19 towards its open position. However, when the bellows arrangement 24 reaches its upper end position, in which position the lower bellows 35 is completely compressed, the lower pressure member 27 will rest on the ring element 31 via the compressed bellows 35, which annular ring element 31 will then take the biasing forces generated by the pressure of the control fluid.

In the disclosed embodiment the injection fluid valve 19, the actuating device 22 and the bellows arrangement 24 are arranged along the central axis of the valve body 9. This provides for an effective and space efficient configuration of the valve arrangement 8.

Figure 2:
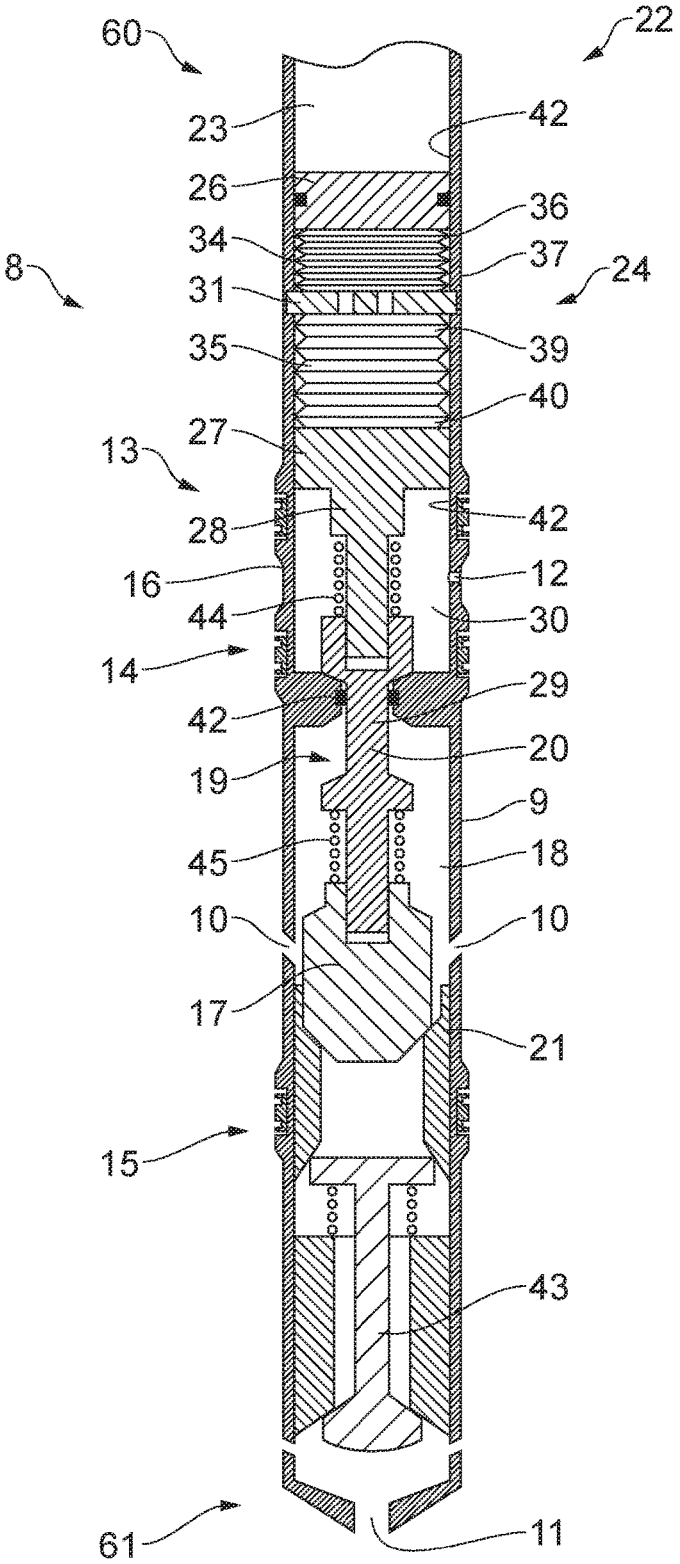
FIG. 2 is a schematic cross sectional view of an embodiment of the valve arrangement according to the invention.

As is evident from FIG. 2, the seal stem 20 runs through the control fluid chamber 30 and the injection fluid chamber 18. In order to prevent injection fluid from entering the control fluid chamber 30 and, vice versa, preventing hydraulic control fluid from entering the injection fluid chamber 18, an annular, dynamic seal 42 is arranged in the valve body 9 between the injection fluid chamber 18 and the control fluid chamber 30, which seal 42 provides a fluid tight seal between the seal stem 20 and the inside wall of the valve body 9.

A barrier or outlet valve 43 acting as a reverse-flow check valve may advantageously be arranged downstream of the injection fluid valve 19 to prevent production fluid from entering the injection fluid chamber 18 when the pressure in the production tubing becomes higher than the pressure in the annulus. This valve may be any type of barrier, outlet or check valve which is known in the art.

In order to insure a fluid-tight seal between the valve stem head 17 and the valve seat 21, it may be advantageous to divide the valve stem 20 into a first, upper stem section 28 and a second, lower stem section 29, as is disclosed in FIG. 2, and connect the lower stem section 29 to the upper stem section 28 such that the lower stem section 29 can move in the longitudinal direction of the valve body 9 relative to the upper stem section 28. In such an embodiment, a first spring 44 is advantageously arranged between the stem sections 28, 29 to bias the lower stem section 29 in a downward direction relative to the upper stem section 28. Likewise, it may be advantageous to connect the valve stem head 17 to the lower stem section 29 such that the valve stem head 17 can move in the longitudinal direction of the valve body 9 relative to the lower stem section 29. In such an embodiment a second spring 45 is advantageously arranged between the valve stem head 17 and the lower stem section 29 to bias the valve stem head 17 in a downward direction relative to the lower stem section 29.

The operation of the valve arrangement 8 will now be discussed. As discussed in relation to FIG. 1, the operation of the valve arrangement 8 requires that a control line 7 is run to the side-pocket mandrel in which the valve arrangement 8 is to be mounted. Prior to mounting the valve arrangement 8 in the side-pocket mandrel, the dome 23 is pressurised to a predefined pressure level, which is chosen according to the intended working depth of the valve arrangement. For example, the pressure level may be within the range of 100 to 700 bar. Thereafter, the valve arrangement 8 is mounted in a side-pocket mandrel, e.g. by means of a wireline operation, such that the inlet ports 10, the outlet ports 11 and the control line ports 12 are brought into communication with the corresponding ports or openings in the side-pocket mandrel. Then, in operation, the injection fluid valve 19 can be opened and closed by means of an operator increasing and reducing the pressure in the control line 7 and, consequently, in the control fluid chamber 30, e.g. from the surface of the well. The hydraulic fluid in the control fluid chamber 30 will produce an upwardly directed force acting on the lower pressure member 27, and the pressurised gas in the dome 23 will produce a downwardly directed force acting on the upper pressure member 26.

In order to open the injection fluid valve 19, the operator will increase the pressure in the control line 7 and, consequently, in the control fluid chamber 30. When the pressure in the control fluid chamber 30 becomes sufficiently high to generate an upwardly directed force acting on the lower pressure member 27 that overcomes the downwardly directed force acting on the upper pressure member 26 due to the gas pressure in the dome 23, the valve stem head 17 will be lifted from the valve seat 21 by means of the movement of the bellows arrangement 24 and injection gas will be able to flow through the injection valve 19 and further through the barrier or outlet valve 43 and into the production tubing 5. If the pressure in the control fluid chamber 30 becomes sufficiently large to force the bellows arrangement 24 into its upper end position, in which position the lower bellows 35 is completely compressed and the injection valve 19 is in its maximum open position, the upwardly biasing force generated by the hydraulic control fluid will be taken up by the ring element 31, as has been discussed above, and the dome 23 will not be subjected to an excessive upwardly biasing force.

In order to close the injection fluid valve 19, the operator reduces the pressure in the control line 7 and, consequently, in the control fluid chamber 30. When the pressure in the control fluid chamber 30 becomes sufficiently low to allow the downwardly directed force acting on the upper pressure member 26 to overcome the upwardly directed force, the valve stem head 17 will be brought back into contact with the valve seat 21 and the injection valve 19 will be closed. If the pressure in the control fluid chamber 30 becomes sufficiently low to allow the bellows arrangement 24 into its lower end position, in which position the upper bellows 34 is completely compressed and the injection valve 19 is closed, the downwardly biasing force generated by the gas pressure in the dome 23 will be taken up by the ring element 31, as has been discussed above.

When operating a well having a plurality of valve arrangements, as is disclosed in FIG. 1, the actuating force of the actuating device in each valve arrangement shall be set according to intended operation depth such that the actuating force of each valve arrangement is higher than the actuating forces of the valve arrangements positioned above. By arranging the actuating forces in this manner, and also connecting each valve arrangement to the same control line, the operator can open the valve arrangements in sequence from the top valve arrangement and downwards by increasing the control line pressure. Consequently, when operating a well having a plurality of valve arrangements comprising gas-charged domes, the dome pressure in each valve arrangement shall be set such that the dome pressure of each valve arrangement is higher than the dome pressure of the neighbouring above valve arrangement.

Figure 3:
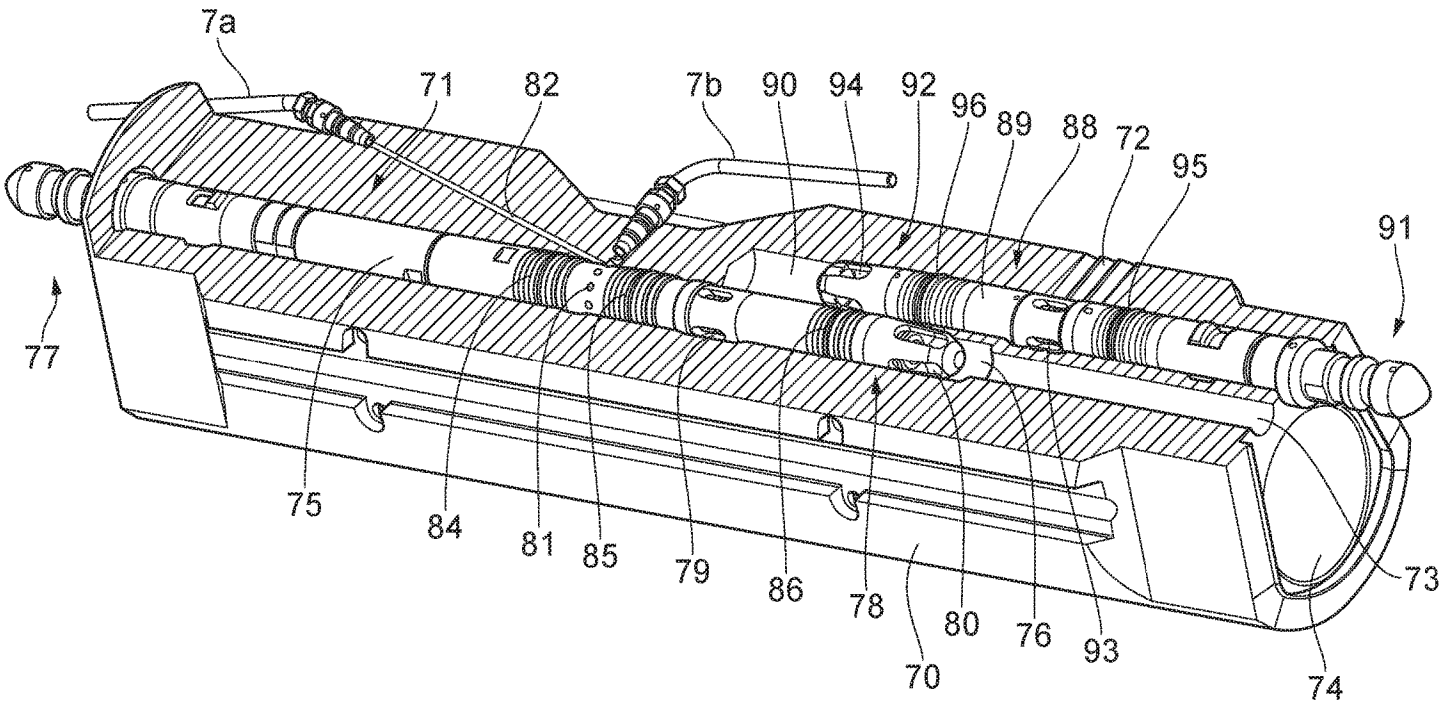
FIG. 3 is a partly cut-open view of a side-pocket mandrel comprising a valve arrangement according to the invention.
Figure 4:
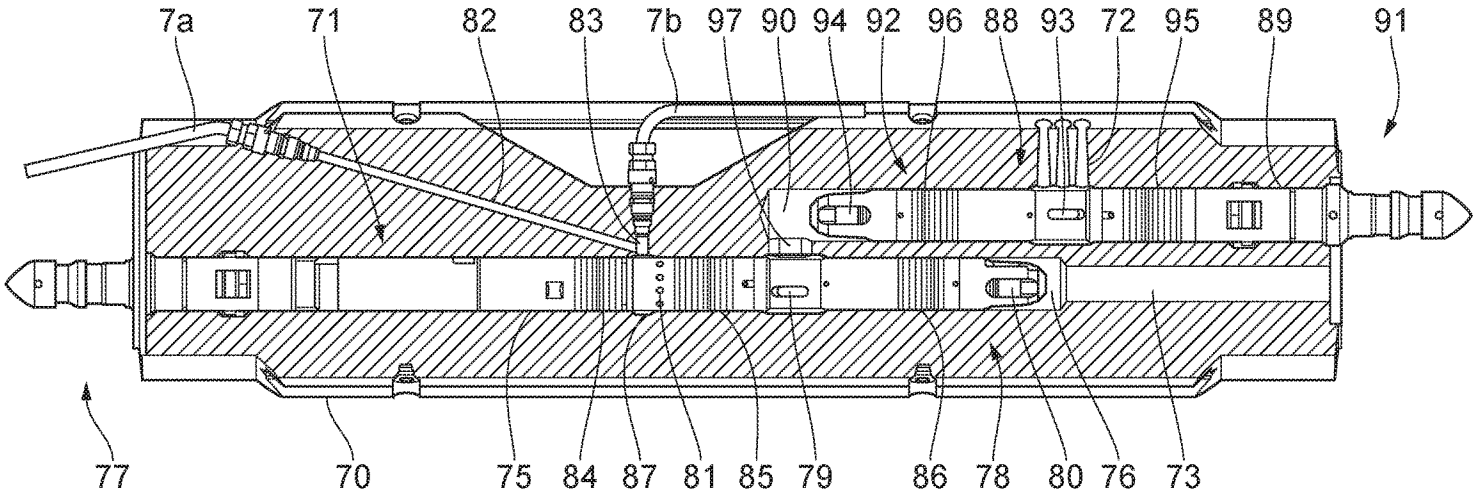
FIG. 4 is a side-view of the side-pocket mandrel according to FIG. 3.

FIGS. 3 and 4 disclose an embodiment of a side-pocket mandrel 70 comprising a valve arrangement 71 according to the invention. The side-pocket mandrel 70 comprises inlet openings 72 for receiving injection fluid from a well annulus, and an outlet opening 73 for delivering the injection fluid to a well conduit, or production tubing, 74 of the side-pocket mandrel 70.

The valve arrangement 71 comprises an elongated and generally cylindrical valve body 75 which may be made from one or a plurality of body sections. The shape of the valve body 75 is such that the valve arrangement 71 can be retrievably and sealably inserted into a first landing receptacle or pocket 76 of the side-pocket mandrel 70. To this end, the shape of the valve body 75 generally corresponds to the shape of the inner side wall of the pocket 76, and the valve arrangement 71 may be installed and removed from the pocket 76 in a manner which is, as such, known in the art, e.g. by means of a wireline operation via the production tubing.

The valve body 75 comprises a first end 77 and a second end 78. The valve body 75 also comprises a plurality of inlet ports 79 for receiving injection fluid from the well annulus. At one side of the inlet ports 79, towards the second end 78, the valve body 75 comprises a plurality of outlet ports 80 for delivering the injection fluid to the production tubing 74 via the opening 73. At the other side of the inlet ports 79, the valve body 75 comprises a plurality of control line ports 81 which are arranged to communicate with hydraulic control lines 7*a*, 7*b* via corresponding openings or conduits 82, 83 in the side-pocket mandrel 70. Consequently, in the longitudinal direction of the valve body 75, the inlet ports 79 are positioned between the outlet ports 80 and the control line ports 81.

The hydraulic control lines 7*a*, 7*b* lead to neighbouring side-pocket mandrels in the well, as is disclosed in FIG. 1.

The valve arrangement 71 further comprises first 84, second 85 and third 86 annular sealing arrangements or seal stacks which are arranged around the valve body 75 to provide fluid tight seals between the valve body 75 and the generally cylindrical inner side wall of the receiving pocket 76 when the valve arrangement 71 is mounted therein. The control line ports 81 are positioned between the first seal stack 84 and the second seal stack 85 such that the seal stacks 84 and 85 seal of an annular space or recess 87 (see FIG. 4) surrounding the control line ports 81 when the valve arrangement 71 is mounted in the side-pocket mandrel 70, which space or recess 87 is configured to form the interface between the control line ports 81 and the corresponding openings 82, 83. The inlet ports 79 are positioned between the second seal stack 85 and the third seal stack 86 such that the seal stacks 85 and 86 seal of the inlet ports 79 when the valve arrangement 71 is mounted in the side-pocket mandrel 70. The third seal stack 86 is positioned between the outlet ports 80 and the inlet ports 79 such that leakage between the well annulus and the well conduit is prevented.

The interior of the valve arrangement 71 corresponds to the interior of the above-disclosed valve arrangement 8 in that it comprises:

an injection fluid valve (not visible in FIGS. 3 and 4) being arranged in fluid communication with the inlet ports 79 and the outlet ports 80 and being operable between an open position and a closed position for controlling the flow of the injection fluid through the valve arrangement 71, an actuating device (not visible in FIGS. 3 and 4) for actuating the injection fluid valve towards the closed position, a bellows arrangement (not visible in FIGS. 3 and 4) comprising a first pressure member, a second pressure member and at least one bellows element enclosing at least one bellows chamber comprising a bellows fluid, wherein the pressure members are hydraulically connected via the bellows fluid, and a control fluid chamber (not visible in FIGS. 3 and 4) being arranged inside the valve body 75 adjacent to the second pressure member and in fluid communication with the control line ports 81, wherein the control fluid chamber comprises a hydraulic control fluid for biasing the injection fluid valve towards the open position via the second pressure member.

Advantageously, the injection fluid valve, the actuating device, the bellows arrangement and the control fluid chamber are identical to the injection fluid valve 19, the actuating device 22, the bellows arrangement 24 and the control fluid chamber 30, respectively, as disclosed in FIG. 2 and are arranged to operate in the same way.

The side-pocket mandrel according to the invention may comprise only one valve, i.e. the valve arrangement according to the invention. However, in some applications it may be advantageous to arrange additional valves in the side-pocket mandrel, e.g. a second valve which is arranged in series with the valve arrangement according to the invention. FIGS. 3 and 4 disclose such a configuration, where the side-pocket mandrel 70 comprises a second valve 88 which is retrievably and sealably inserted into a second landing receptacle or pocket 90 of the side-pocket mandrel 70.

Like the valve arrangement 71 according to the invention, the second valve 88 comprises an elongated and generally cylindrical valve body 89 which may be made from one or a plurality of body sections. The shape of the valve body 89 is such that the second valve 88 can be retrievably and sealably inserted into the second pocket 90 of the side-pocket mandrel 70. To this end, the shape of the valve body 89 generally corresponds to the shape of the inner side wall of the pocket 90, and the second valve 88 may be installed and removed from the pocket 90 in a manner which is, as such, known in the art, e.g. by means of a wireline operation via the production tubing.

The valve body 89 comprises a first end 91 and a second end 92. The valve body 89 also comprises one or a plurality of inlet ports 93 for receiving injection fluid from the well annulus. At the second end 92, the valve body 89 comprises a plurality of outlet ports 94 which communicate with the inlet ports 93 via an internal valve body and valve seat configuration (not disclosed). Such valve body and valve seat configurations are known as such and will not be discussed in any detail here.

The valve arrangement 71 further comprises first 95 and second 96 annular sealing arrangements or seal stacks which are arranged around the valve body 89 to provide fluid tight seals between the valve body 89 and the generally cylindrical inner side wall of the receiving pocket 90 when the second valve 88 is mounted therein. The inlet ports 93 are positioned between the seal stacks 95, 96 such that the seal stacks 95, 96 seal of the inlet ports 93 when the valve 88 is mounted in the side-pocket mandrel 70. The second seal stack 96 is positioned between the inlet and outlet ports 93, 94 such that leakage between the outlet ports 94 and the well annulus is prevented.

The side-pocket mandrel 70 comprises a conduit 97 (cf. FIG. 4) which fluidly connects the first pocket 76 to the second pocket 90. The conduit 97 extends between the inner section of the second pocket 90 and the middle section of the first pocket 76 such that a flow path from the outlet ports 94 of the second valve 88 to the inlet ports 79 of the valve arrangement 71 is enabled. The side-pocket mandrel 70 is thus configured to provide a flow path from the annulus to the production tubing via the second valve 88 and the valve arrangement 71, wherein the valve arrangement 71 is positioned in series with the second valve 88. Consequently, when the second valve 88 and the valve arrangement 71 are open, the fluid in the annulus is allowed to flow, in order, through the inlet openings 72, the inlet ports 93, the second valve 88, the outlet ports 94, the conduit 97, the inlet ports 79, the injection fluid valve 19 (cf. FIG. 2), the barrier or outlet valve 43 (cf. FIG. 2), the outlet ports 80, and, finally, through the outlet opening 73 and into the production tubing.

The second valve 88 may be of a type which is, as such, known in the art. For example, the second valve 88 may be an injection pressure operated gas lift valve which allows an injection fluid to flow from the inlet ports 93 to the outlet ports 94. Preferably, the second valve comprises a check valve function which does not allow fluid to flow in the other direction, i.e. from the outlet ports 94 to the inlet ports 93. This allows the valve arrangement 71 to be removed from the first pocket 76 without the fluid barrier between the production tubing and the annulus of the well being compromised. Also, this configuration provides a dual-barrier configuration in which the barrier or outlet valve 43 forms a first barrier and the second valve 88 forms a second barrier for the fluid in the production tubing.

In the disclosed embodiment, the first 76 and second 90 pockets extend from opposite ends of the side-pocket mandrel 70. Also, the pockets 76, 90 are parallel but axially offset. However, other configurations are possible while maintaining the serial relationship between the second valve 88 and the valve arrangement 71. For example, the pockets may be axially aligned and/or extend from the same end of the side-pocket mandrel.

While the disclosed subject matter has been described with reference to illustrative embodiments, this description is not intended to be construed in a limiting sense. Various modifications of the illustrative embodiments, as well as other embodiments of the subject matter, are possible within the scope of the claimed invention.

The invention claimed is:

1. A valve arrangement for controlling the flow of an injection fluid from a well annulus into a well conduit of a hydrocarbon well, comprising:

a valve body being insertable into a side pocket mandrel of the hydrocarbon well, the valve body comprising:

at least one inlet port for receiving the injection fluid from the well annulus;

at least one outlet port for delivering the injection fluid to the well conduit;

an injection fluid valve being arranged in fluid communication with the least one inlet port and the at least one outlet port and being operable between an open position and a closed position for controlling the flow of the injection fluid through the valve arrangement;

an actuating device for actuating the injection fluid valve towards the closed position; and a bellows arrangement comprising a first pressure member, a second pressure member and at least one bellows element enclosing at least one bellows chamber comprising a bellows fluid, wherein the pressure members are hydraulically connected via the bellows fluid, wherein the injection fluid valve is connected to the second pressure member, and the actuating device is arranged adjacent to the first pressure member for biasing the injection fluid valve towards the closed position via the first pressure member, the bellows fluid and the second pressure member;

at least one control line port being arranged in the valve body for fluid communication with a control line of the well; and a control fluid chamber being arranged inside the valve body adjacent to the second pressure member and in fluid communication with the at least one control line port, wherein the control fluid chamber comprises a hydraulic control fluid for biasing the injection fluid valve towards the open position via the second pressure member.

2. The valve arrangement according to claim 1, wherein the actuating device, the bellows arrangement and the injection fluid valve are arranged along a central axis of the valve body.

3. The valve arrangement according to claim 1, wherein the bellows arrangement is positioned between the actuating device and the injection fluid valve.

4. The valve arrangement according to claim 1, wherein the at least one bellows element comprises a first bellows element enclosing a first bellows chamber and a second bellows element enclosing a second bellows chamber, wherein the first and second bellows chambers are in fluid communication with each other.

5. The valve arrangement according to claim 1, wherein the actuating device comprises a gas-charged dome.

6. The valve arrangement according to claim 1, wherein the injection fluid valve comprises a valve stem and a valve seat, wherein the valve stem runs through the control fluid chamber and the injection fluid chamber, and wherein a dynamic seal is arranged between the injection fluid chamber and the control fluid chamber to provide a fluid tight seal between the seal stem and the valve body in order to prevent injection fluid from entering the control fluid chamber and to prevent hydraulic control fluid from entering the injection fluid chamber.

7. The valve arrangement according to claim 1, wherein first, second and third annular sealing arrangements are arranged around the valve body for providing fluid tight seals between the valve body and a receiving pocket of a side-pocket mandrel, wherein said at least one control line port is positioned between the first sealing arrangement and the second sealing arrangement, and wherein the said at least one inlet port is positioned between the second sealing arrangement and the third sealing arrangement.

8. The valve arrangement according to claim 1, wherein a reverse-flow check valve is arranged downstream of the injection fluid valve to prevent production fluid from entering the injection fluid chamber.

9. A method of operating a hydrocarbon well comprising a plurality of side-pocket mandrels arranged at different depths, comprising the steps of:

connecting the side-pocket mandrels to a surface control line;

installing a valve arrangement according to any one of the preceding claims in each side-pocket mandrel, wherein the actuating device of each valve arrangement is configured to provide a biasing force to the first pressure member which is larger than the corresponding biasing force of the neighbouring above valve arrangement; and opening a desired number of the valve arrangements in the side-pocket mandrels in sequence from the top side-pocket mandrel and downwards by increasing the control line pressure.

10. A side-pocket mandrel for placement in a hydrocarbon well, comprising a valve arrangement according to any one of claims 1-8.

11. The side-pocket mandrel according to claim 10, further comprising a second valve which is arranged in series with the valve arrangement providing a dual-barrier valve configuration between a well conduit and a well annulus of the hydrocarbon well.

12. The side-pocket mandrel according to claim 11, wherein the second valve is positioned between the well annulus and the valve arrangement.

* * * * *